US007131538B2

(12) United States Patent
Johannsen

(10) Patent No.: US 7,131,538 B2
(45) Date of Patent: Nov. 7, 2006

(54) MATERIAL CLASSIFIER HAVING A SCOOP WHEEL

(75) Inventor: Thor J. Johannsen, Norval (CA)

(73) Assignee: Thor Global Enterprises Ltd., Ontario (CA)

( * ) Notice: Subject to any disclaimer, the term of this patent is extended or adjusted under 35 U.S.C. 154(b) by 251 days.

(21) Appl. No.: 10/705,551

(22) Filed: Nov. 11, 2003

(65) Prior Publication Data

US 2005/0098483 A1 May 12, 2005

(51) Int. Cl.
*B07B 9/00* (2006.01)
*B03B 7/00* (2006.01)

(52) U.S. Cl. ..... 209/18; 209/492; 209/684; 209/685; 209/935; 198/701; 198/702; 198/703; 198/713; 210/330

(58) Field of Classification Search ..... 209/18, 209/492, 684, 685, 935; 198/701, 702, 703, 198/713
See application file for complete search history.

(56) References Cited

U.S. PATENT DOCUMENTS

| | | | | |
|---|---|---|---|---|
| 924,682 A | | 6/1909 | Maignen | |
| 1,107,472 A | | 8/1914 | Allen | |
| 2,106,156 A | | 1/1938 | Munro | |
| 2,189,418 A | * | 2/1940 | Finney | 209/18 |
| 2,226,750 A | | 12/1940 | Traylor | |
| 2,322,415 A | * | 6/1943 | Buckbee | 210/330 |
| 2,453,293 A | | 11/1948 | Aurilio et al. | |
| 2,990,064 A | | 6/1961 | Schoeneck | |
| 3,773,176 A | | 11/1973 | Loughner | |
| 4,035,288 A | * | 7/1977 | Gibert et al. | 209/466 |
| 4,151,074 A | | 4/1979 | Mohri | |
| 4,543,180 A | | 9/1985 | Riker | |
| 4,915,826 A | * | 4/1990 | Nordhus | 209/288 |
| 5,082,553 A | * | 1/1992 | Tanii | 209/3 |
| 5,290,401 A | | 3/1994 | Savisalo et al. | |
| 5,490,928 A | * | 2/1996 | Tanii | 210/380.3 |

FOREIGN PATENT DOCUMENTS

| | | | |
|---|---|---|---|
| GB | 2143444 A | * | 2/1985 |
| JP | 1 075 006 A2 | | 3/1989 |
| WO | WO 02/32798 A1 | | 4/2002 |

* cited by examiner

*Primary Examiner*—Kathy Matecki
*Assistant Examiner*—Terrell Matthews
(74) *Attorney, Agent, or Firm*—Hodgson Russ LLP

(57) ABSTRACT

A material classifier for classifying a liquid-solid mixture containing solid material to be separated. The material classifier includes a tank and an angularly mounted scoop wheel for scooping solid material which has settled on the bottom of the tank.

26 Claims, 10 Drawing Sheets

MATERIAL CLASSIFIER HAVING A SCOOP WHEEL

BACKGROUND OF THE INVENTION

The present invention relates to material classifiers, and more particularly to material classifiers having a scoop wheel.

Material classifiers are used for many different purposes, including the separation or classification of solids according to size and/or particle density. The solids to be separated are mixed in a suitable liquid such as water, to create a liquid-solid mixture or pulp which is then passed to the tank of the classifier. Larger particles settle to the bottom of the classifier tank while fine particles remain in suspension in the liquid medium (called the overflow) which is drawn or overflows from the classifier. Material classifiers also provide cleaning of the solid particles.

Many different types of material classifiers are known, including mechanical and non-mechanical types. One type of mechanical classifier uses a driven wheel having flights, lifts, drags, blades, scoops, scrappers or other means to lift solid material which has settled on the bottom of the tank and discharge it upon a discharge chute, conveyor belt or other means for collecting and transporting the settled material.

A known material classifier, an example of which can be seen in U.S. Pat. No. 1,107,472, issued Aug. 18, 1914, uses V-shaped troughs ("buckets") or scrapers spaced around the circumference of a cylindrical classifier tank or vessel. The vessel is partially filled with water and slowly rotates. Materials lighter than water will float on the Water's surface and be discharged from the vessel via an overflow trough. Heavier materials sink to the bottom of the vessel and are scooped-up by the buckets as they rotate. When the buckets reach a specified height within the vessel, the contents of the buckets are dumped onto a spout which discharges the material from the vessel.

Another known material classifier, an example of which can be seen in U.S. Pat. No. 2,226,750, issued Dec. 31, 1940, uses a circular wheel with radially spaced blades. Heavier solids scooped-up by the blades are pushed to a discharge lip. Lighter solids are kept in suspension and exit the classifier at an overflow point such as a weir. The classifier blades have a cam mechanism which allows the blades to retract as they move upwards beyond the discharge lip. On the downward rotation the blades are lowered into the water edgewise to minimize the liquid surge caused by the blades entering the water.

Most known sand classifiers and cleaning systems use a screw mechanism for moving the sand along the classifier. These designs are commonly referred to as rotary-drum or screw-conveyor type classifiers, an example of which can be seen in U.S. Pat. No. 4,151,074, issued Apr. 24, 1979. Screw classifiers can be complex, prone to wear, and can be expensive and costly to maintain and set up.

A common drawback of existing classifier designs is that good classifying ability is typically achieved at the expense of capacity and vice versa. Typically, a material classifier has either: (1) good classifying ability but low capacity and a complicated reclaiming system; or (2) high capacity and relatively simple reclaiming system but poor classifying ability. Also, material classifiers with good classifying ability typically offer a much greater classifying ability than is typically required as most finer grade materials have fewer uses.

A further drawback of most material classifiers is that they are large and not easily portable between job sites. Typically, material classifiers must be loaded onto a truck, for example using a forklift, lift truck or crane, transported to the designed location, and then unloaded. Loading and unloading of the classifier results in significant downtime and requires equipment at both the initial and final destinations to perform the loading/unloading operation.

Thus, there is a need for a material classifier that is more cost effective and reliable, less prone to wear and requiring lower maintenance, has a higher capacity and/or that is more compact and can be more easily transported.

SUMMARY OF THE INVENTION

The present invention obviates or mitigates some of the foregoing problems in the prior art by in one example embodiment, providing a material classifier and system for classifying a liquid-solid mixture using an angled scoop wheel. In another example embodiment, the invention includes multiple scoop wheels arranged in series and operating at different speeds. In yet another example embodiment, the scoop wheels are offset from the classifying stream. In various example embodiments, the material classifier of the present invention can be used to classify sand and other materials, has a lay-out convenient for the feeding and discharging, can be used in series to increase capacity or throughput, gradation, and can be relatively easily transported.

In accordance with at least one example of the present invention, there is provided a material classifier for classifying a liquid-solid mixture containing solid material to be separated, including: a first tank for receiving the liquid-solid mixture; and a first wheel angularly mounted at least partially within the first tank to rotate about a first wheel axis tilted at an angle relative to a horizontal reference, the first wheel having a plurality of spaced apart radially extending scoops about a periphery thereof for scooping up solid material from within the first tank and subsequently discharging the scooped solid material outside of the first tank during rotation of the first wheel.

In accordance with at least another example of the present invention, there is provided a material classifier for classifying a liquid-solid mixture containing solid material to be separated, including: a tank for receiving the liquid-solid mixture, the tank having a plurality of sidewalls including a tilt sidewall positioned at an angle relative to the vertical; a wheel rotatably and angularly mounted for rotation within the tank, wherein the wheel is mounted within the tank at a tilt angle relative to the vertical and which corresponds to the angle of the tilt sidewall, the wheel being mounted adjacent to the tilt sidewall; a plurality of elongate scoops attached about a periphery of the wheel for scooping solid material which has settled on a bottom of the tank; and a drive mechanism for rotating the wheel within the tank.

In accordance with at least a further example of the present invention, there is provided a method of classifying material, including: providing a scoop wheel having a plurality of scoops located about a periphery thereof and mounted to rotate a scoop wheel axis that is tilted relative to a horizontal reference, the scoop wheel having a downwardly oriented first side and being located in a tank having an upwardly extending wall adjacent the first side of the scoop wheel, the wall having an upper limit above which the scoops extend during rotation; adding a liquid-solid mixture to the tank to a predetermined fill level; rotating the scoop wheel to scoop settled solid material from a bottom of the tank; rotating the scoop wheel further to discharge the scooped material from the first side of the scoop wheel when the scooped material is above the upper limit.

In accordance with at least a yet further example of the present invention, there is provided a material classifier for classifying a liquid-solid mixture having various grades of solid material therein, including: (a) a first classifier stage for removing a first predetermined grade of solid material from the liquid-solid mixture, including: a first tank for receiving the liquid-solid mixture; a first wheel rotatably mounted at least partially within the first tank, the first wheel having a plurality of spaced apart radially extending scoops about a periphery thereof for scooping up solid material from within the first tank and subsequently discharging the scooped solid material outside of the first tank during rotation of the first wheel; (b) a second classifier stage for removing a second predetermined grade of solid material from the liquid-solid mixture, including: a second tank connected to the first tank for receiving some of the liquid-solid mixture from the first tank; and a second rotatably mounted at least partially within the second tank, the second wheel having a plurality of spaced apart radially extending scoops about a periphery thereof for scooping up solid material from within the second tank and subsequently discharging the scooped solid material outside of the second tank during rotation of the second wheel; and (c) independently controllable drives for the first wheel and the second wheel for rotating the first wheel and second wheel at different speeds relative to each other, and a variable gate between the first and second tanks for controlling respective liquid-solid mixture levels therein.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Reference will now be made to-the accompanying drawings which show, by way of example, embodiments of the present invention, and in which.

Figure 1:
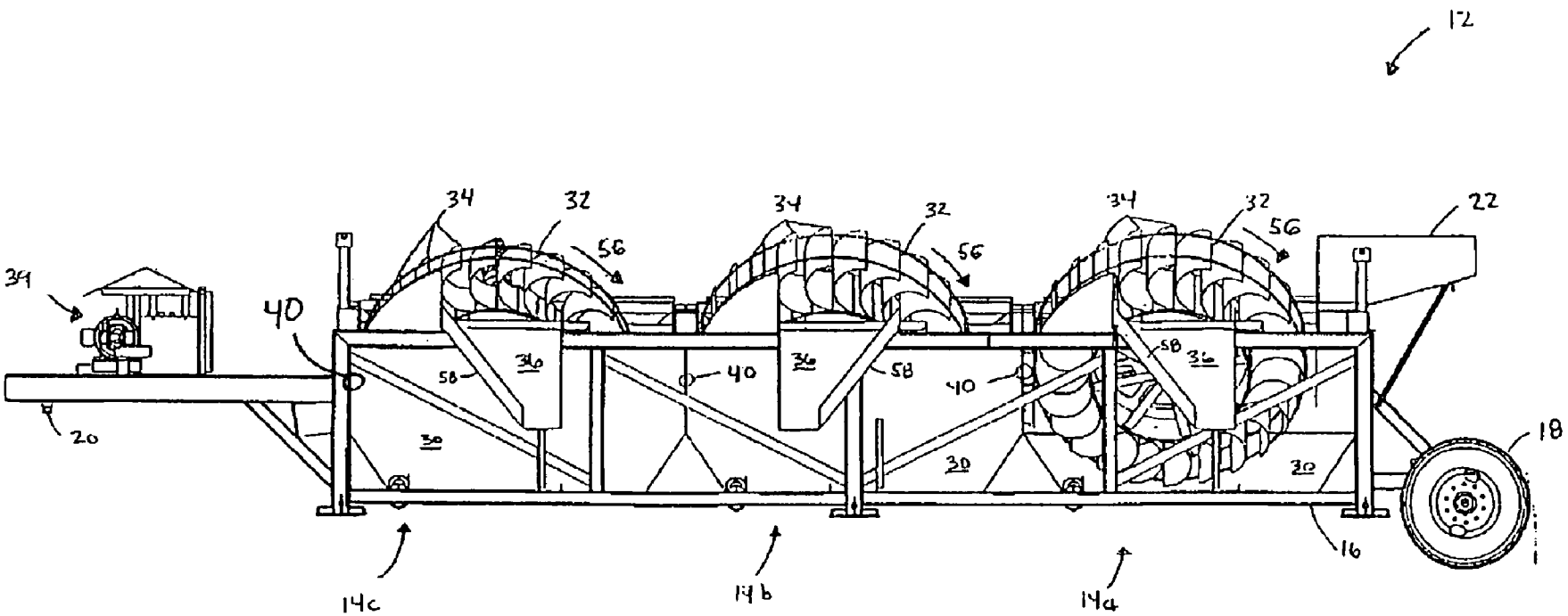
FIG. 1 is a side view of a material classifier constructed according to at least one example of the present invention with a cut-away portion showing a scoop wheel.
Figure 2:
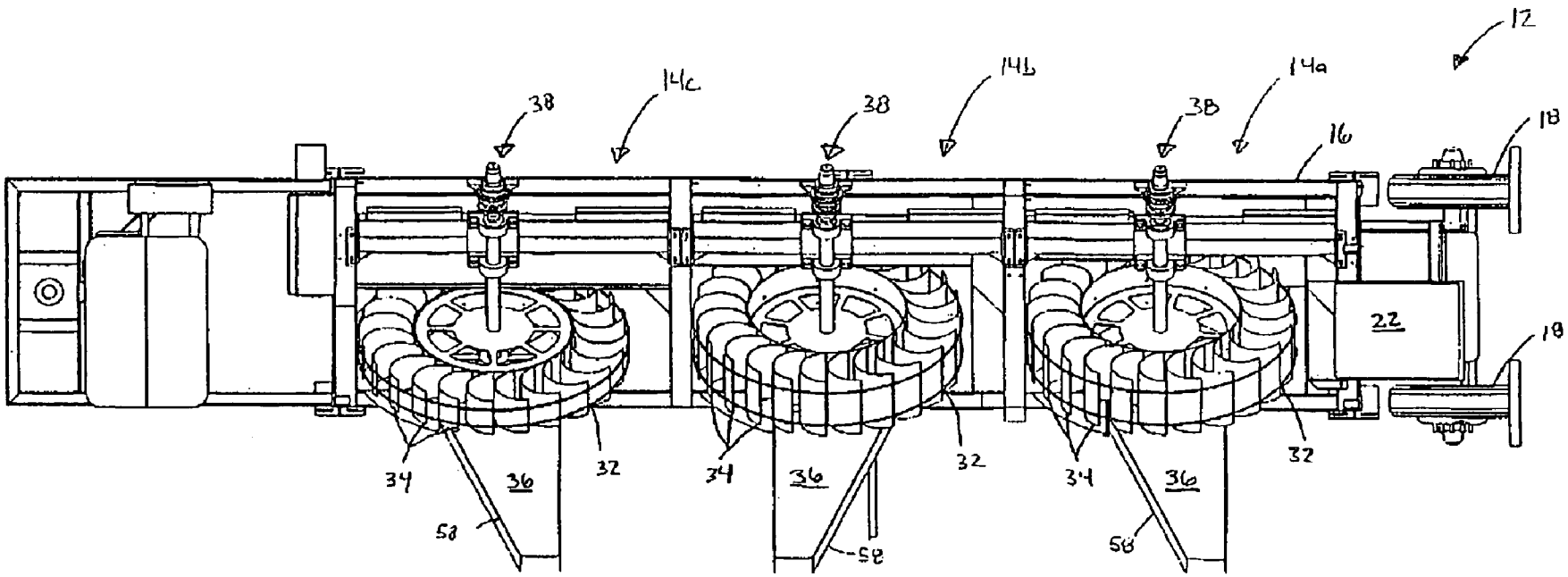
FIG. 2 is a top view of the material classifier of FIG. 1.
Figure 3:
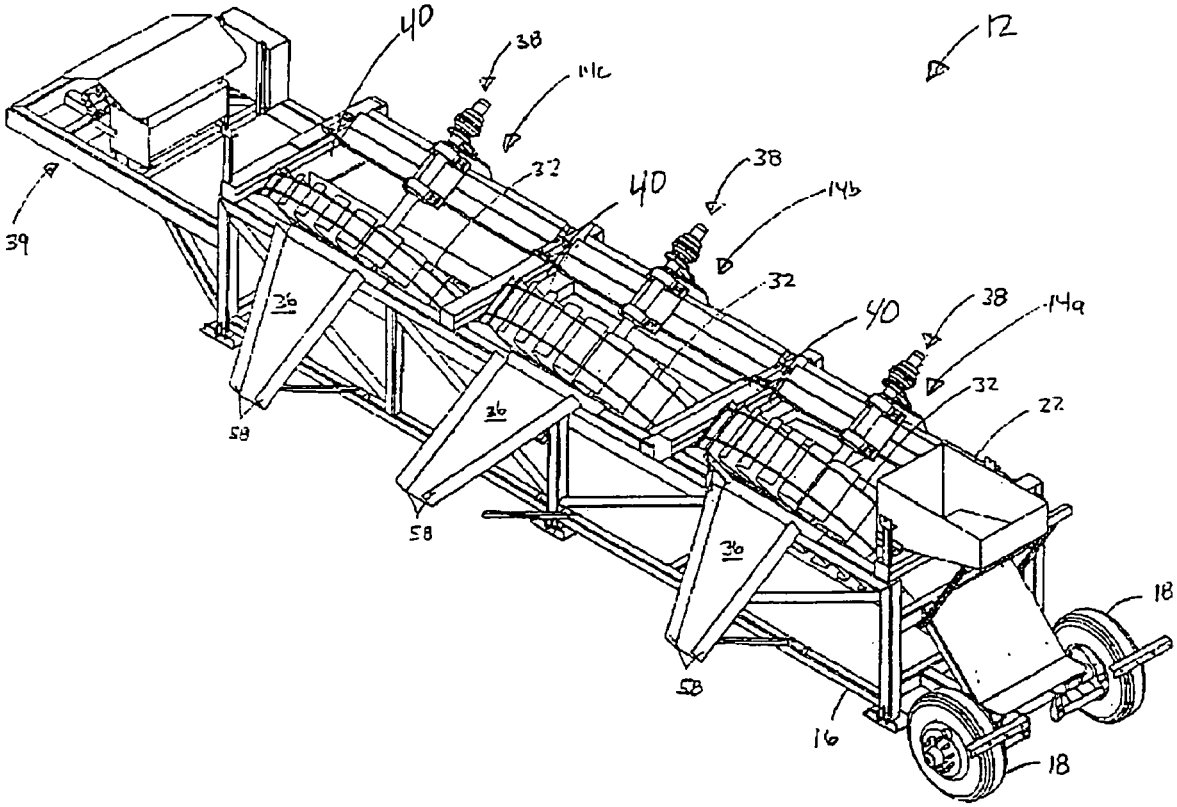
FIG. 3 is a perspective view of the material classifier of FIG. 1.
Figure 4:
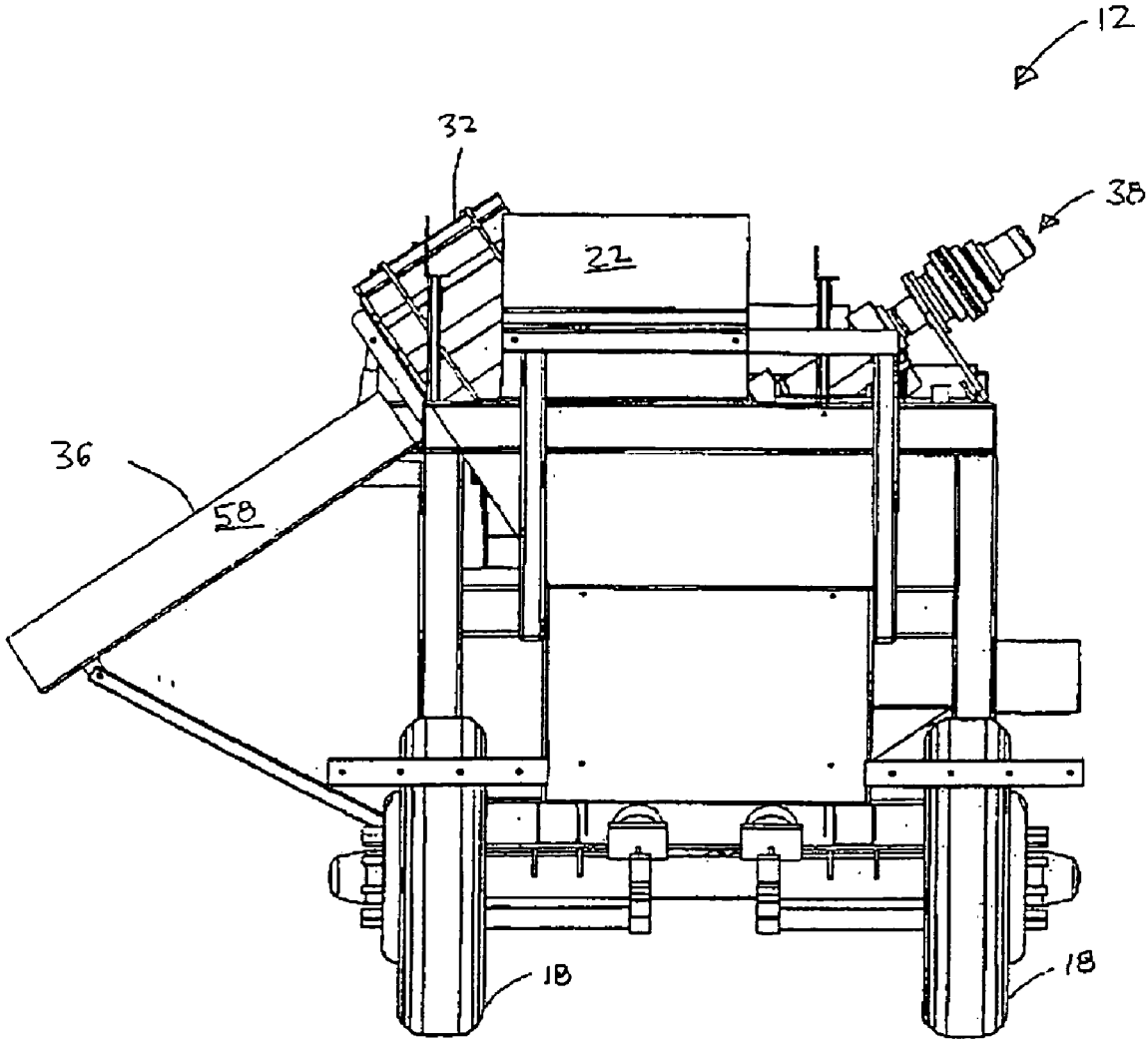
FIG. 4 is an end view of the material classifier of FIG. 1.

Similar references are used in different figures to denote similar components.

DETAILED DESCRIPTION OF THE INVENTION

Reference is first made to FIG. 1 to 4, which show a system 12 for classifying a liquid-solid mixture implemented according to the present invention. The system 12 comprises material classifiers 14, indicated individually by references 14*a*, 14*b* and 14*c*, a support frame 16, wheels 18, hitch 20, and mixing box 22. The material classifiers 14 are coupled in succession to form a series of three classifier stages beginning with the first material classifier 14*a*. In other embodiments, greater or fewer stages may be used. A single material classifier 14 may be used, if desired.

Each material classifier 14 comprises a tank or hopper 30, and an angularly mounted wheel 32 having a plurality of radially extending, curved scoops or lifts 34. The wheels 32 and their corresponding lifts 34 scoop settled material out of the hoppers 30 and deposit it on discharge ramps or chutes 36. Each discharge chute 36 directs the scooped material onto a corresponding conveyor belt 37 (FIG. 7) which transports the material elsewhere, for example, to a discharge pile (not shown) for open storage. Other transport means may be used to transport the material from the discharge chutes 36. Each of the wheels 32 is driven by an independently controllable drive mechanism 38. For example, in one embodiment each wheel drive mechanism 38 is a hydrostatic drive, powered by a common motor 39. In other embodiments, alternative drive mechanisms are used, such as independent motors for each wheel, for example. In an example embodiment, the rate of rotation of the wheels 32 is different for each stage, with the wheel 32 in the first stage having a higher rpm than the wheel 32 in the second stage, which in turn has a higher rpm than the wheel in the third stage. Generally, slower rotation results in less agitation and allows lighter material to settle on the bottom of the hopper 30 so that it can be collected by the lifts 34. However, slow rates of rotation reduce the rate at which settled material is collected from the hoppers. Thus, process requirements are considered when selecting the appropriate rates of rotation for the wheels 32.

Figure 5:
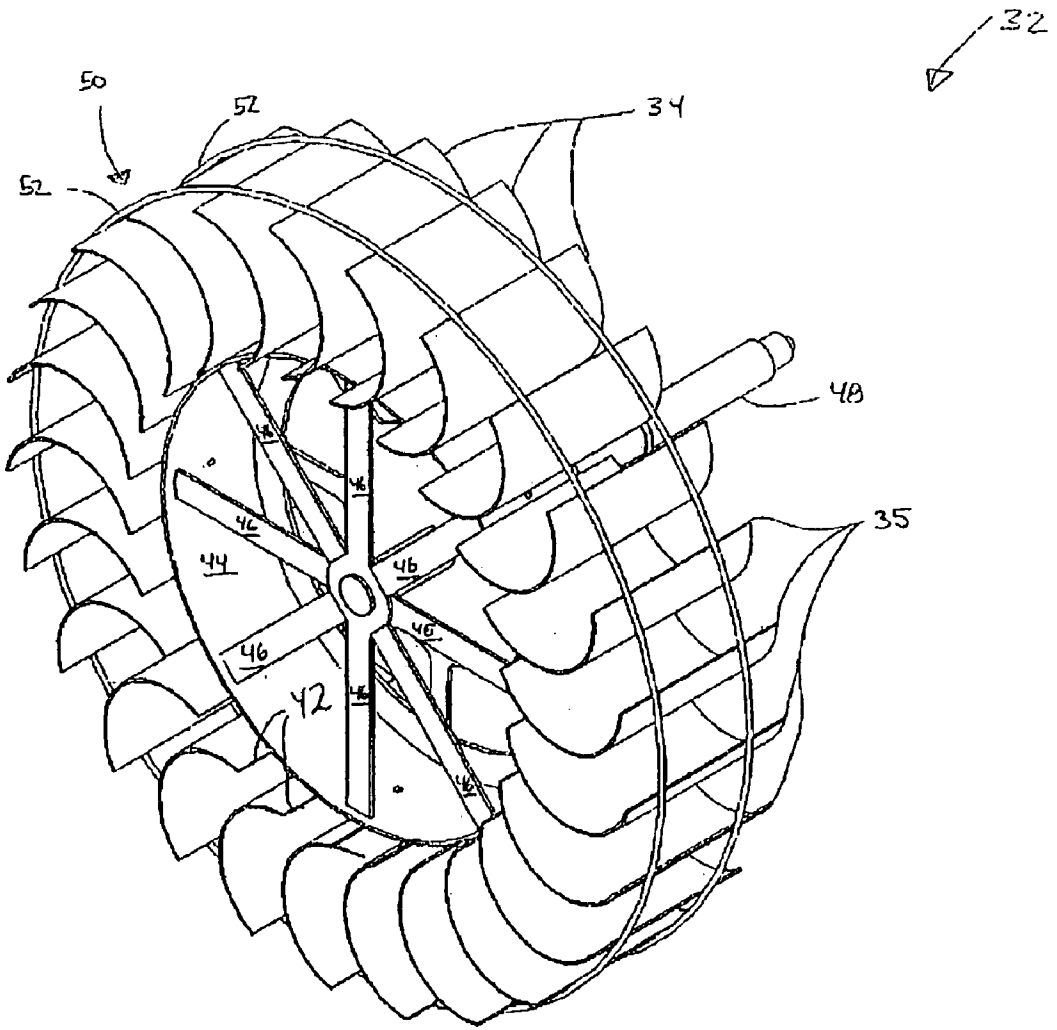
FIG. 5 is a perspective view of the scoop wheel of the material classifier of FIG. 1.
Figure 6:
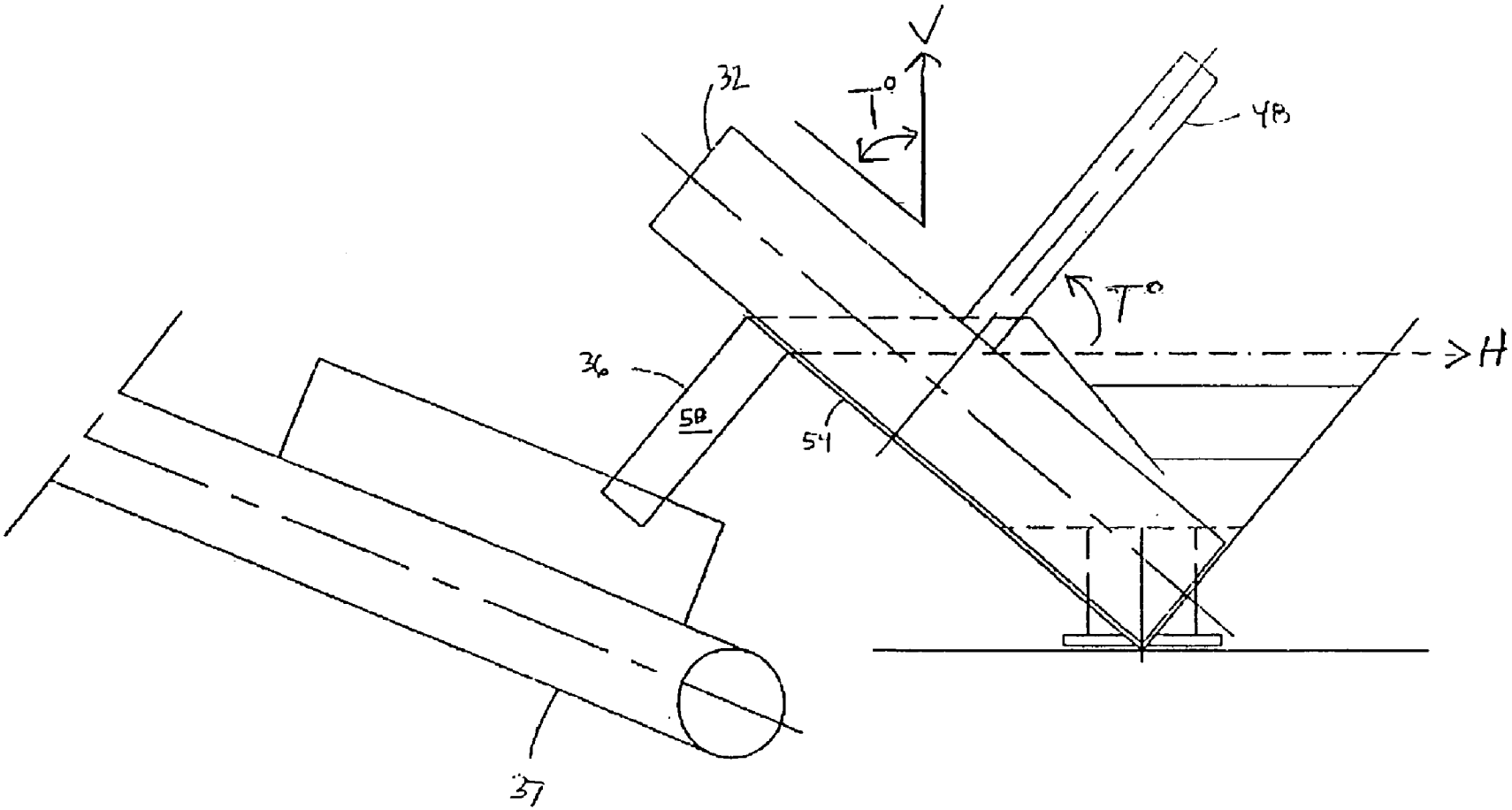
FIG. 6 is an schematic diagram of the material classifier of FIG. 1, associated with a conveyor belt for transport of discharged solid material.
Figure 9A:
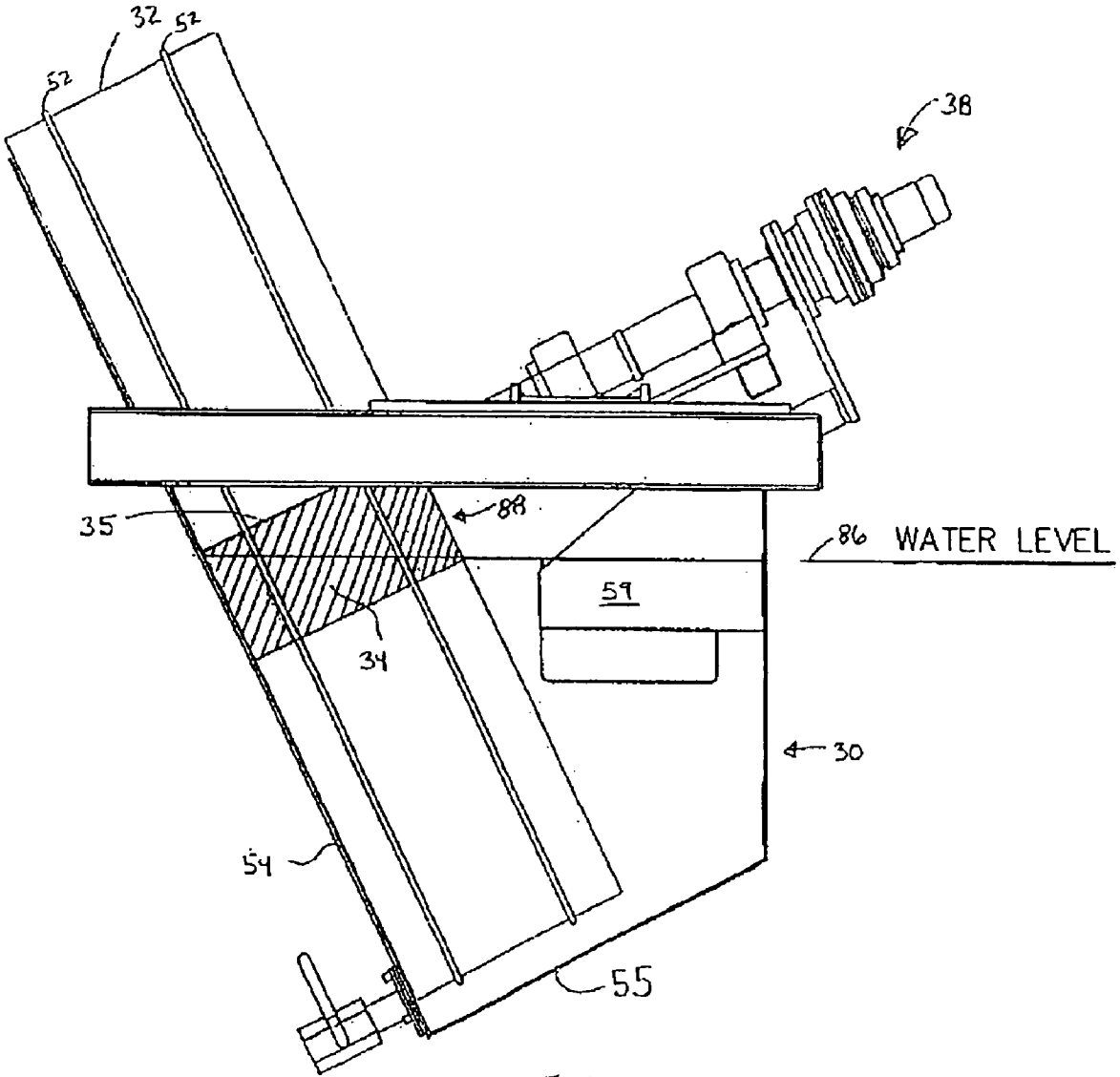
FIG. 9A is a sectional end view of the material classifier of FIG. 1 showing the water line in the hopper during operation.

Referring now to FIGS. 6 and 9A, the hoppers 30 will be described in more detail. The hoppers 30 each have a tilt sidewall 54 adjacent to the respective wheel 32. The angle of the tilt sidewall 54 corresponds to the tilt angle T° at which the wheel 32 is mounted relative to the vertical V, thus ensuring that substantially all of the solid material scooped up by the wheels 32 remains on the lifts 34 until the lifts 34 reach their respective discharge chutes 36. When the lifts 34 reach the discharge chute 36, the scooped material carried by the lifts 34 falls down the chute 36 and onto the corresponding conveyor belt 37. The hoppers 30 also include an overflow weir or gate 40 providing an opening (FIG. 9A) which establishes an upper limit for the water level in each of the hoppers 30 and allows excess water and suspended particles to exit each hopper 30 to the next stage in the classifier system Referring now to FIG. 5, a wheel 32 will be described in more detail. Each wheel 32 comprises scoops or lifts 34, an inner hub 44, spokes 46, drive shaft 48, and an outer hub 50 comprised of concentric support bars 52. The drive shaft 48 of each wheel 32 is coupled to its corresponding drive mechanism 38 (FIG. 1-4). To facilitate side-discharge from the wheels 32, the wheels 32 are angularly mounted to have a downwardly oriented side within the corresponding material classifier 14 at an angle T° to the vertical V (referred to as the tilt angle). Thus, the axis of rotation of each wheel 32 is angled T° from the horizontal H. In various embodiments, the tilt angle is selected based on the classifying application that the system 12 is used for. For example in one embodiment, the tilt angle is equal to or less than 50 degrees from the vertical. In another example embodiment, the tilt angle is substantially 32 degrees from the vertical. However, such angles are merely examples and the tilt angle can vary in various embodiments to achieve desired results for the material being classified.

The lifts 34 each include an outer flight edge 35 which engages settled material on the bottom of the hoppers 30. The lifts 34 are oriented such that the curvature of the lifts 34 opens in the direction of movement of the wheels 32, thus allowing the lifts 34 to scoop material settled on the bottom of the hoppers 30. In one example embodiment, the lifts 34 are detachable to assist in transportation of the system 12 by lowering its overall height. In such embodiments, the lifts 34 are attached to the inner hub 44 using bolts or other suitable removable fasteners. In other example embodiments, the support bars 52 are divided into sections with a plurality of lifts 34 attached to each section. These sections may then be attached and detached to the inner hub 44 as required, allowing for easier transportation and repair of the system 12. In an example embodiment, the inner hub 44 is narrower than the lifts 34 such that the inner hub 44 is spaced apart from the tilt sidewall 54, allowing water to flow off the inner edge portions 42 of the lifts 34 that extend beyond the inner hub 44, during rotation of the wheel 32.

As shown in FIG. 9A, in an example embodiment, the bottom wall 55 is, angled so that it is perpendicular to the tilt sidewall 54, such that the bottom wall 55 is substantially parallel to the outer flight edge 35 of the lifts 34, and so that settled aggregate material collects in the portion of the hopper 30 where the wheel 32 is located. As the wheel 32 rotates upwards with full lifts 34, the lifts 34 rise out of the water with material trapped in the lifts 34 and supported by the tilt sidewall 54. Before discharging the collected material, a dewatering process occurs wherein water trapped by the lifts 34 flows off and back into the hopper 30. The dewatering process continues until the lifts 34 reach the top of the hopper 30 and are discharged.

Referring now to FIGS. 1 and 6, the discharge of solid material collected by the system 12 will be described. The discharge chutes 36 of each stage are associated with a corresponding conveyor belt 37. The discharge chutes 36 are angled downwards towards the conveyor belts 37 to facilitate discharging. Vertical guides 58 on each side of the discharge chutes 36 direct and channel scooped material toward the lower end of the chutes 36 and onto the corresponding conveyor belts 37. In other embodiments, the discharge chutes 36 direct collected material onto a single conveyor belt with separate channels for material from each of the classifier stages.

Referring now to FIG. 1 to 4, the operation of an example embodiment of the system 12 will be described in more detail. The direction of movement of the wheels 32 is indicated by reference 56. In this embodiment, the wheels 32 of each classifier 14 rotate in the direction of the mixing box 22. Screened aggregate material is fed by a conveyor belt (not shown) or other transport means into the mixing box 22. Water is continuously fed into the mixing box 22 through an inlet pipe (not shown). The water and aggregate material forms a liquid-solid mixture or pulp that passes through the mixing box 22 and into the hopper 30 of the first classifier 14*a*. A gate 40 provides an opening between the hopper 30 of the first classifier 14*a* and the hopper 30 of the second classifier 14*b* which allows water and suspended material to flow from the first stage to the second stage. Similarly, a gate 40 provides an opening between the hopper 30 of the second classifier 14*b* and the hopper 30 of the third classifier 14*c* which allows water and suspended material to flow from the second stage to the third stage. A gate 40 is also provided at a discharge end of the hopper 30 of the final stage 14*c*. The gates 40 include a control mechanism that allows the gate opening to be enlarged or contracted by raising or lowering the gates 40. Controlling the size of the gate openings allows the flowrate of water and suspended solids between classifier stages to be controlled, and consequently the water level in each of the hoppers 30. In one example embodiment, water flow through the system 12 is regulated such that the water level drops from the first stage to the second stage, and then from the second stage to third stage. Other means for controlling the flow through the system 12 may be used in addition to, or in place of, the gates 40. In some embodiments, the water level in the hoppers 30 is also controlled by pumping some of the water from one or more later stages back into earlier stages.

Although aspects of the present invention can be used for sorting a number of different types of material, for example various types of aggregate and reclaimed solids from sewage or wastewater treatment operations, hereinafter the use of the system 12 as a sand classifier will be described.

Figure 7:
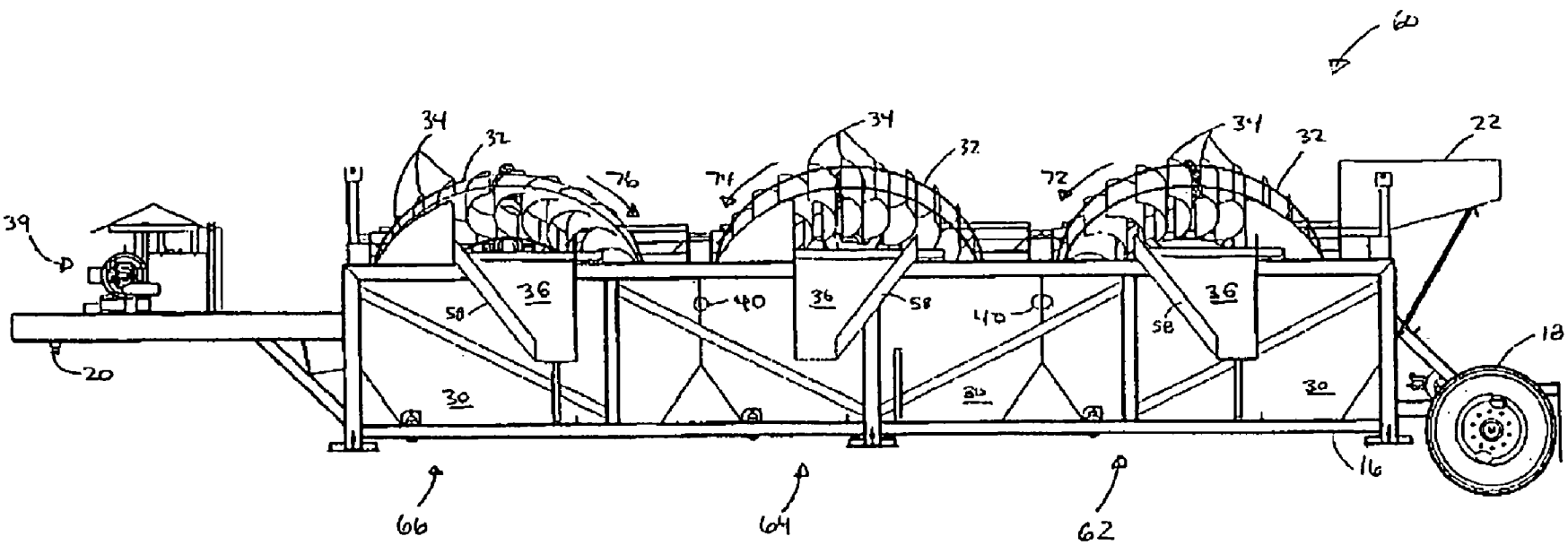
FIG. 7 is a side view of a second embodiment of a material classifier constructed according to the present invention.

In the first stage, the speed of the wheel 32 is selected so that a predetermined amount of settled solids are collected in the first stage 14*a*. In some embodiments, the rotation of the wheel 32 contributes to agitation of the water in the hopper 30 of the first classifier 14*a* such that sand particles that are generally less than a predefined mass are kept suspended, whereas particles that are generally heavier than the predefined mass sink to the bottom of the hopper 30, where they are scooped up by the lifts 34 of the wheel 32. As the wheel 32 rotates, upward moving lifts 34 emerge from the water. As the lifts 34 emerge, water captured by the lifts 34 is drained off and returned to the hopper 30. Some suspended particles are carried back with the water into the hopper 30. As the wheel 32 rotates further, the lifts 34 rotate past the discharge chute 36 and scooped material carried on the lifts 34 slides off and down the discharge chute 36 to a collection device such as a conveyor belt 37 (FIG. 7). Lighter particles that remain suspended in the water of the first stage then pass through the gate 40 and into the hopper 30 of the second stage.

In the second stage, similar to the first stage, the wheel 32 turns at a speed such that a predetermined amount of settled solids are collected in the second stage 14*b*. In some embodiments, the rotation of the wheel 32 contributes to agitation of the water in the hopper 30 of the second classifier 14*b* such that particles that are generally below a certain mass are suspended in the water in the hopper 30, while particles that are generally heavier than that mass sink to the bottom of the hopper 30, where they are scooped up by the lifts 34 of wheel 32 of the second stage. As in the first stage, when the lifts 34 emerge from the water as the wheel 32 rotates, water captured by the lifts 34 is initially drained off and returned to the hopper 30. As the wheel 32 rotates further, the lifts 34 rotate past the discharge chute 36 and scooped material carried on the lifts 34 slides off and down the discharge chute 36 to a collection device such as a conveyor belt 37 (FIG. 7). Lighter particles that remain suspended in the water of the second stage then pass through the next gate 40 and into the hopper 30 of the third stage.

In the third stage, very fine particles or silt are removed. The wheel 32 of the third classifier 14*c* moves at a speed slow enough that silt particles can settle on the bottom of the hopper 30, where they are scooped up by the lifts 34 of the wheel 32 and deposited on the discharge chute 36 of the third stage. Water leaves the third stage by the final gate 40 (FIG. 9A) and is sent to a tailings pond (not shown). This water contains residual suspended solids that did not settle on the bottom of the hopper 30 of the third stage. The rate of rotation of the wheel 32 in the third stage is selected so that a predetermined percentage of silt particles are removed. In one embodiment, the speed of the wheel is selected to obtain 20 percent recovery of silt particles. Recovery of silt particles reduces the need for and cost associated of recovering silt from the tailings pond.

It will thus be appreciated that in this embodiment, sand passing through the system 12 is both cleaned and classified into different sizes. The range of sizes extracted at each stage depending upon a number of variables including, for example, the rate at which the aggregate material and water is fed into the system 12, the agitation occurring in the mixing box 22, the distance from the mixing box 22, the rates at which the wheels 32 rotate, the size and number of lifts 34 on the wheels 32, and the location and size of the gate openings between stages.

A programmable logic controller (PLC) or other suitable controller may be used to improve process control in relation to the rate which the aggregate material is fed to system 12, the rate that water is fed to system 12, the rate of rotation of the wheels 32, and possibly the size of the gate openings between the stages.

Variations of the system 12 will now be described. In one embodiment, the wheel 32 in the first stage rotates between 8 and 12 rpm, the wheel 32 in the second stage rotates between 4 and 6 rpm, and the wheel 32 in the third stage rotates at less than 4 rpm. Such speeds are provided merely as non-limiting examples and other speeds for the wheels 32 are possible with desired wheel speed depending upon, among other things, wheel size, hopper size, the number and size of lifts, tilt angle and the material being classified. Further, the speed at which each of the wheels 32 rotates is a selectable parameter and need not decrease between successive stages as in the present embodiment. In some embodiments, each wheel 32 rotates at the same speed.

Wheel speed, wheel size, the number of lifts, lift size, shape and spacing, title angle, hopper size, gate size and opening, among other things, are parameters that can vary in different embodiments of the invention, and can vary between the classifier stages in some embodiments, in order to achieve desired results for the material being classified. For example, in some embodiments, the wheel 32 in the third stage has narrower lifts 34 than the wheels 32 in the first and second stages. Shorter lifts 34 may be used in the third stage because the volume of aggregate material removed in this stage is smaller compared to the first and second stages where the bulk of the material is removed.

Generally, the wheel speed is set to rotate as quickly as possible, but slow enough to allow the dewatering process to occur. If the wheel speed is set too high, the water will not run off the lifts 34 and will be scooped out of the hoppers 30 with the discharged material. The number of lifts 34 per wheel is set such that the wheel 32 is filled, however the lifts 34 cannot be packed so tightly that the operation or one lift 34 interferes with the operation of the adjacent lifts 34. The length of the lifts 34 is typically set to achieve a certain tons per hour capacity. Wheel diameter is typically as large as possible to increase capacity, but small enough for the system 12 to be transported (for example in a freight container), and small enough to be manageably setup by the end user.

In the embodiment of FIG. 1 to 4, the system 12 is supported by the common frame 16 which has wheels 18 at one end thereof, and a hitch 20 at the opposite end thereof so that the classifier can be easily moved, for example, by towing the system 12. In one non-limiting example embodiment, the system 12 is sized to be easily transported in a conventional freight container (for example a container having approximate interior dimensions of 7'-6"×39'-6"). In other embodiments, the system has a stationary configuration and is not readily portable. In yet other embodiments, the classifiers 14 are separate units that do not share a common frame.

Figure 8:
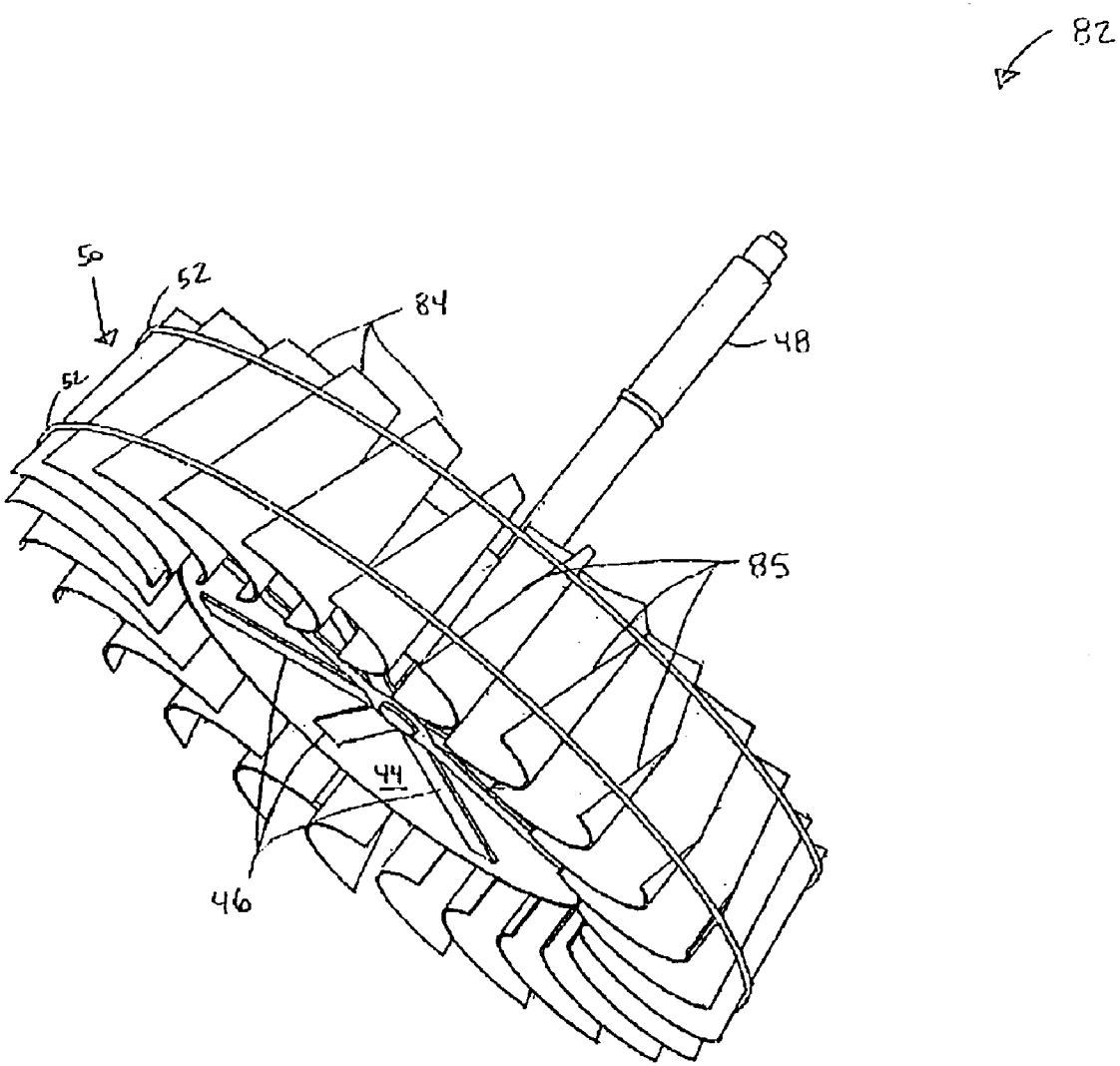
FIG. 8 is a perspective view of an alternate embodiment of a scoop wheel for a material classifier implemented according to the present invention.

Reference is now made to FIG. 7, which shows a further example embodiment of a system 60 for classifying a liquid-solid mixture implemented according to the present invention. The system 60 is similar to the system 12, except that the orientation of the wheels 32 is different. The system 60 comprises three material classifiers indicated individually by references 62, 64 and 66. The first and second classifiers 62 and 64 rotate in the direction of the hitch 20, whereas the third classifier 66 rotates in the opposite direction towards the mixing box 22. The direction of movement of the wheels 32 is indicated individually by references 72, 74, and 76 (FIG. 8). As with the system 12, the lifts 34 are curved in the direction of movement of the wheels 32 to scoop the material settled on the bottom of the hoppers 30.

Figure 9B:
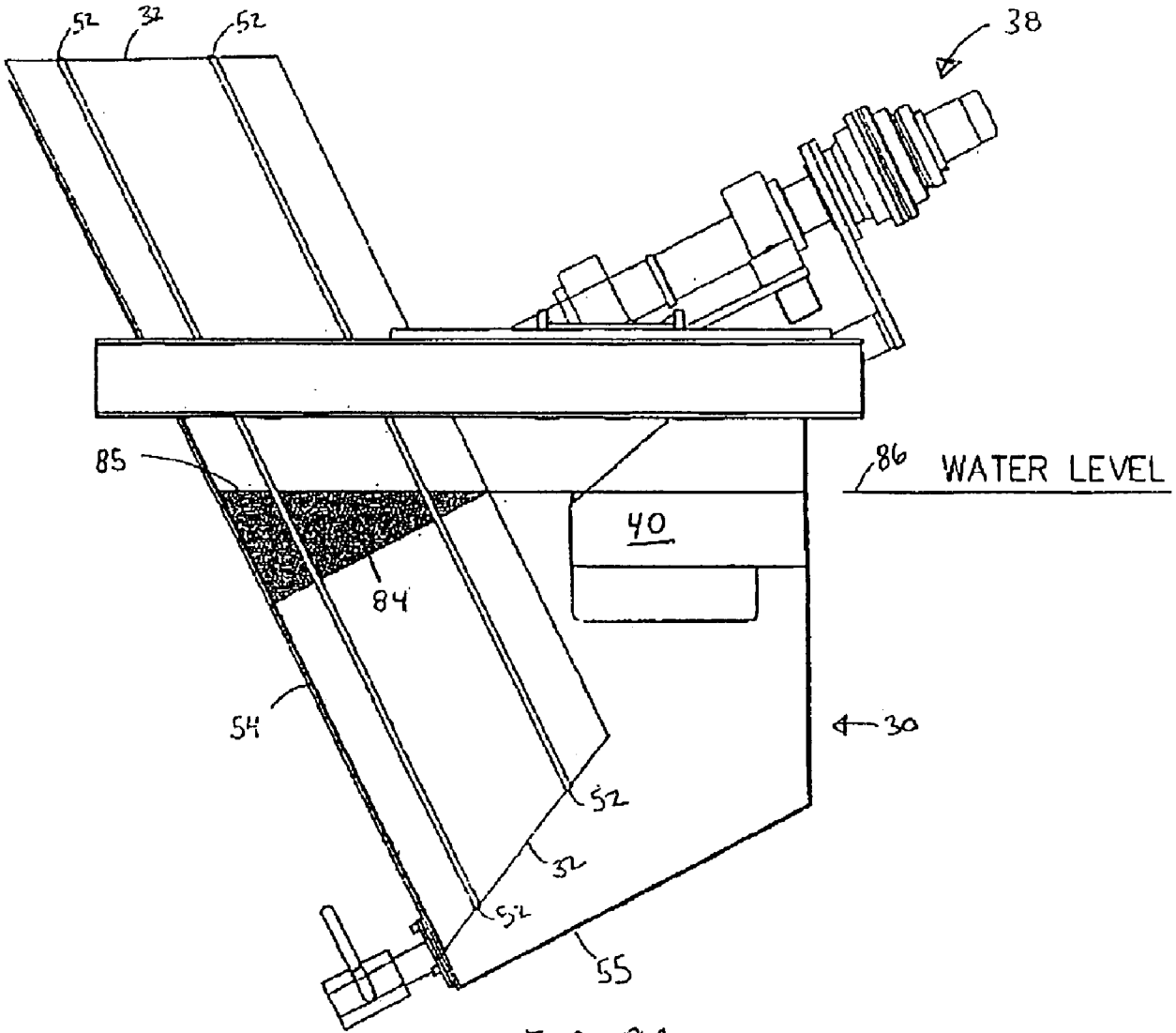
FIG. 9B is a sectional end view of a material classifier having the scoop wheel of FIG. 8 showing the water line in the hopper during operation.

Reference is now made to FIGS. 8 and 9B, which show an alternative embodiment of a material classifier 80 according to the present invention. The material classifier 80 is similar to the material classifier 14, with the exception that the shape of the lifts attached to the scoop wheels is different. Each material classifier 80 comprises a tank or hopper 30 having a tilt sidewall 54, and an angularly mounted wheel 82 having a plurality of radially extending, curved scoops or lifts 84. Each lift 84 has a flight edge 85 which engages settled material on the bottom of the hoppers 30. As before, the wheels 82 and their corresponding lifts 84 serve the dual purpose of agitating the contents of each of the hoppers 30, and scooping material out of the hoppers 30 and depositing it on discharge ramps or chutes 36.

Similar to the lifts 34 of the system 12, the lifts 84 are curved in the direction of movement of the wheels 82 to scoop the material settled on the bottom of the hoppers 30. However, the lifts 84 are tapered away from the tilt sidewall 54 such that the flight edge 85 of the lifts is substantially parallel to the surface of the water in the tank. In this manner, the taper of each lift 84 corresponds to the tilt angle at which the wheels 82 are mounted within the hoppers 30. Tapering of the lifts 84 provides improved ejection of the water carried by the lifts 84 when they emerge from the water during the discharge operation.

Referring now to FIGS. 9A and 9B, the tapering of the lifts 84 will be explained in more detail. FIG. 9A illustrates a wheel 32 of a material classifier 14 with a liquid-solid mixture such as sand and water received therein. The water line in the hopper 30 is indicated by reference 86. For convenience, only one lift 34 is shown. Similarly, FIG. 9B illustrates a wheel 82 of the material classifier 80 with a liquid-solid mixture such as sand and water received therein. The water line in the hopper 30 is indicated by reference 86.

Referring now to FIG. 9A, it will be appreciated that as the wheel 32 emerges from the water at the water line 86, the entire flight edge 35 of the lift 34 does not emerge from the water at one time, rather an upper portion 88 of the lift 34 emerges first. Referring now to FIG. 9B, it will be appreciated that tapering allows the entire flight edge 85 of the lift 84 to emerge from the water at one time, thus allowing captured water to be ejected evenly from the lifts 84 from both sides thereof.

Other variations of the material classifier are possible. Instead of using separate hoppers for each wheel 32, a single large tank could be used to house all the wheels 32. Minor adjustments to the classifier may be required in the single tank configuration, for example, baffles may be needed to provide some separation between the classifier stages. In this embodiment, lighter particles held in suspension are allowed to flow to the far end of the tank nearest the last wheel 32. In other embodiments, more or few classifier stages are used, for example, in one example embodiment only two classifier stages are used with the overflow from the second stage containing very fine particles or silt, which is sent to a tailings pond. In still other example embodiments, only a single classifier stage and wheel is used. In another example embodiment, multiple classifier stages are used, with the wheels 32 operating at different speeds, but the tilt angle is substantially 0° from the vertical V, the wheels being serially offset to allow for material discharge.

It will be appreciated by one of skill in the art that in some embodiments of the present invention, the wheels 32 are offset to one side from the flow of the classifying stream, i.e. the flow of the liquid-solid mixture, through the system 12 such that in each tank, the classifying stream can flow from the intake end to the gate (outtake end) past the offset wheel. Offsetting of the wheels 32 can partially or completely isolate or separate the wheels 32 from the classifying stream, depending on the specific embodiment. In such cases, rotation of the wheels 32 contributes very little, if at all, to the agitation of the classifying stream, and the distance from the mixing box 22 becomes one of the dominant factors which affect the settling rate and size of settled particles in a particular stage when other variables remain constant.

The present invention may be embodied in other specific forms without departing from the spirit or essential characteristics thereof. Certain adaptations and modifications of the invention will be obvious to those skilled in the art. Therefore, the presently discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. A material classifier for washing, classifying and dewatering a liquid-solid mixture containing solid material, comprising:

a tank defining a reservoir having a first end at which the liquid-solid mixture is received and a second end from which liquid from the liquid-solid mixture is discharged, the tank including an angled side wall located between the first end and the second end;

a first wheel mounted at least partially within the tank adjacent the side wall to rotate about a first wheel axis that is tilted at an angle relative to a horizontal reference and that is substantially perpendicular to the side wall, the first wheel having a plurality of spaced apart radially extending scoops about a periphery thereof for scooping up a first grade of solid material from within the tank and subsequently discharging the scooped solid material from the side wall to outside of the tank during rotation of the first wheel; and a second wheel mounted at least partially within the tank adjacent the side wall and further from the first end than the first wheel to rotate about a second wheel axis that is tilted at an angle relative to a horizontal reference and that is substantially perpendicular to the side wall, the second wheel having a plurality of spaced apart radially extending scoops about a periphery thereof for scooping up a second grade of solid material from within the tank and subsequently discharging the scooped solid material from the sidewall to outside of the tank during rotation of the second wheel.

2. The material classifier of claim 1 wherein the side wall substantially conforms to a downwardly oriented first side of the first wheel for impeding scooped solid material from discharging from the scoops of the first wheel while rotating inside the tank, the side wall having an upper edge portion over which the scoops of the first wheel discharge scooped solid material from the first side of the first wheel when rotated higher than the upper edge portion and the side wall substantially conforms to a downwardly oriented first side of the second wheel for impeding scooped solid material from discharging from the scoops of the second wheel while rotating inside the tank, the side wall having a further upper edge portion over which the scoops of the second wheel discharge scooped solid material from the first side of the second wheel when rotated higher than the further upper edge portion.

3. The material classifier of claim 2 wherein the side wall is substantially planar.

4. The material classifier of claim 2 wherein the tilt of the first wheel axis relative to the horizontal reference is greater than zero degrees and equal to or less than fifty degrees.

5. The material classifier of claim 4 wherein the tilt of the first wheel axis relative to the horizontal reference is greater than 30 degrees.

6. The material classifier of claim 2 wherein the first wheel includes an inner hub from which the scoops thereof extend radially, the scoops of the first wheel each including a scoop wall terminating in an outer scoop edge, the scoops of the first wheel each being substantially open sided on a side thereof at the first side of the first wheel such that scooped material thereon is at least partially supported by the side wall prior to being discharged from the scoops at the first side of the first wheel as the scoops of the first wheel rotate above the upper edge portion of the side wall; and the second wheel includes an inner hub from which the scoops thereof extend radially, the scoops of the second wheel each including a scoop wall terminating in an outer scoop edge, the scoops of the second wheel each being substantially open sided on a side thereof at the first side of the second wheel such that scooped material thereon is at least partially supported by the side wall prior to being discharged from the scoops at the first side of the second wheel as the scoops of the second wheel rotate above the further upper edge portion of the side wall.

7. The material classifier of claim 6 wherein the outer scoop edges of at least some of the scoop walls of the scoops of the first wheel are substantially parallel to the first wheel axis.

8. The material classifier of claim 6 wherein the outer scoop edges of at least some of the scoop walls of the scoops of the first wheel are angled-such that the outer scoop edges of the scoops of the first wheel are not parallel to the first wheel axis.

9. The material classifier of claim 8 wherein the angled outer scoop edges of the scoops of the first wheel are angled to be substantially parallel to a predetermined fill level for the liquid-solid mixture in the tank when the angled outer scoop edges of the scoops of the first wheel are located at the predetermined fill level.

10. The material classifier of claim 6 wherein at least some of the scoops of the first wheel have scoop walls that taper from the first side of the first wheel to a second side thereof.

11. The material classifier of claim 6 wherein the inner hub of at least one of the first and second wheels includes a substantially cylindrical wall from which the scoops extend, at least some of the scoops having a width greater than that of the cylindrical wall.

12. The material classifier of claim 1 wherein at least one section of scoops of the first wheel are connected together as a unit removable from the first wheel.

13. The material classifier as claimed in claim 6, wherein the scoop wall of at least some of the scoops of at least one of the first and second wheels defines a concave region which opens in the direction of rotation of the at least one of the first and second wheels.

14. The material classifier as claimed in claim 6, wherein the scoop wall of at least some of the scoops of the first wheel defines a cavity or hollow which opens in the direction of rotation of the first wheel.

15. The material classifier as claimed in claim 6, wherein the tank further includes a bottom wall that is adjacent to a lower end of the first wheel and is substantially perpendicular to the side wall.

16. The material classifier of claim 1 including independently controllable drives for the first wheel and second wheel for rotating the first wheel and second wheel at different speeds relative to each other, and the first wheel is located in a first tank portion and the second wheel is located in a second tank portion, the material classifier further including a variable gate between the first and second tank portions for controlling respective liquid-solid mixture levels therein.

17. The material classifier of claim 1 further including:

a third wheel angularly mounted at least partially within the tank adjacent the side wall an further from the first end than the second wheel to rotate about a third wheel axis that is tilted at an angle relative to the horizontal reference and that is substantially perpendicular to the sidewall, the third wheel having a plurality of spaced apart radially extending scoops about a periphery thereof for scooping up a third grade of solid material from within the tank and subsequently discharging the scooped solid material from the side wall to outside of the third tank during rotation of the third wheel;

independently controllable drives for each of the wheels for rotating the wheels at separately controllable speeds; and variable gates in the tank between the first and second wheels and the second and third wheels for controlling the flow of liquid-solid mixture therebetween.

18. The material classifier of claim 1, wherein the first and second wheels rotate in opposite directions.

19. The material classifier of claim 1, wherein the first and second wheels rotate in an upstream direction.

20. The material classifier of claim 1, wherein the first and second wheels rotate in a downstream direction.

21. The material classifier of claim 1, including a frame on which the tank is mounted, the frame having transport wheels at least one end thereof.

22. The material classifier of claim 1, wherein the tank has a feed hopper at the first end thereof for feeding the liquid-solid mixture into the tank, and an exit gate at the second end facing the first end, the first wheel and the second wheel being offset to one side of a flow-path through the tank from the feed hopper at the first end to the exit gate at the second end.

23. A method of washing, classifying and dewatering material, comprising:

providing first and second scoop wheels each having a plurality of scoops located about a periphery thereof and mounted to rotate about a respective scoop wheel axis that is tilted relative to a horizontal reference, the scoop wheels being serially arranged one after the other in a tank with the wheel axes thereof being substantially perpendicular to a flow direction of liquid through the tank, each scoop wheel having a downwardly oriented first side, the tank having an upwardly extending wall adjacent the first sides of the scoop wheels;

adding a liquid-solid mixture to a first end of the tank to a predetermined fill level;

rotating the first scoop wheel to scoop settled solid material of a first grade from a bottom of the tank and then subsequently;

discharge the scooped material from the first side of the first scoop wheel over an upper edge portion of the wall;

rotating the second scoop wheel to scoop settled solid material of a second grade from the bottom of the tank and then subsequently discharge the scooped material from the first side of the second scoop wheel over a further upper edge portion of the wall; and discharging liquid from a second end of the tank.

24. A material classifier for classifying a liquid-solid mixture having various grades of solid material therein, comprising:

(a) a first classifier stage for removing a first predetermined grade of solid material from the liquid-solid mixture, including:

a first tank for receiving the liquid-solid mixture;

a first wheel rotatably mounted at least partially within the first tank, the first wheel having a plurality of spaced apart radially extending scoops about a periphery thereof for scooping up solid material from within the first tank and subsequently discharging the scooped solid material outside of the first tank during rotation of the first wheel;

(b) a second classifier stage for removing a second predetermined grade of solid material from the liquid-solid mixture, including:

a second tank connected to the first tank for receiving some of the liquid-solid mixture from the first tank; and a second wheel rotatably mounted at least partially within the second tank, the second wheel having a plurality of spaced apart radially extending scoops about a periphery thereof for scooping up solid material from within the second tank and subsequently discharging the scooped solid material outside of the second tank during rotation of the second wheel; and (c) independently controllable drives for the first wheel and the second wheel for rotating the first wheel and second wheel at different speeds relative to each other, and a variable gate between the first and second tanks for controlling respective liquid-solid mixture levels therein.

25. A material handling system comprising:

a tank for receiving particulate material, the tank having a substantially planar sidewall portion that is non-parallel to a vertical reference when the material handling system is in a use position, the sidewall portion defining a discharge edge at an upper portion thereof over which particulate material can be discharged outside of the tank; and a scoop wheel rotatably mounted within the tank to rotate about an axis that is substantially perpendicular to the sidewall portion and that is non-parallel to a horizontal reference when the material handling system is in the use position, the scoop wheel having a first side that is substantially parallel to the sidewall portion, the scoop wheel having a plurality of circumferentially spaced scoops for scooping particulate material from within the tank as the scoop wheel rotates and subsequently discharging the scooped particulate material over the discharge edge, the scoops each having a substantially open end at the first side of the scoop wheel facing the sidewall portion, the scoops being arranged on the scoop wheel with the open ends thereof being closely spaced to the sidewall portion as the scoops rotate thereby to impede scooped particulate material from discharging from the scoops until the scoops rotate above the discharge edge.

26. The method of claim 23 including recombining in selected amounts the material discharged from the tank by the first and second scoop wheels.

* * * * *